US009702374B2

(12) United States Patent
Emelli et al.

(10) Patent No.: US 9,702,374 B2
(45) Date of Patent: Jul. 11, 2017

(54) SPIRAL PUMPING STAGE AND VACUUM PUMP INCORPORATING SUCH PUMPING STAGE

(71) Applicant: AGILENT TECHNOLOGIES, INC., Loveland, CO (US)

(72) Inventors: Enrico Emelli, Villar Dora (IT); Paolo Cibrario, Favria (IT)

(73) Assignee: Agilent Technologies, Inc., Santa Clara, CA (US)

( * ) Notice: Subject to any disclaimer, the term of this patent is extended or adjusted under 35 U.S.C. 154(b) by 767 days.

(21) Appl. No.: 14/135,501

(22) Filed: Dec. 19, 2013

(65) Prior Publication Data

US 2014/0205433 A1 Jul. 24, 2014

(30) Foreign Application Priority Data

Jan. 22, 2013 (EP) ..... 13152233

(51) Int. Cl.

| | |
|---|---|
| ***F04D 17/02*** | (2006.01) |
| ***F04D 29/44*** | (2006.01) |
| ***F04D 17/16*** | (2006.01) |
| ***F04D 19/04*** | (2006.01) |
| ***F04D 29/40*** | (2006.01) |

(52) U.S. Cl.

CPC ..... *F04D 29/441* (2013.01); *F04D 17/02* (2013.01); *F04D 17/025* (2013.01); *F04D 17/168* (2013.01); *F04D 19/046* (2013.01); *F04D 29/403* (2013.01)

(58) Field of Classification Search

CPC ..... F04D 17/02; F04D 17/168; F04D 19/046; F04D 29/403; F04D 29/441

See application file for complete search history.

(56) References Cited

U.S. PATENT DOCUMENTS

| | | | | |
|---|---|---|---|---|
| 5,688,106 | A * | 11/1997 | Cerruti | F04D 19/046 415/143 |
| 6,030,189 | A * | 2/2000 | Bohm | F04D 19/04 415/90 |
| 2005/0118013 | A1* | 6/2005 | Downham | F04D 23/008 415/55.1 |
| 2010/0158672 | A1* | 6/2010 | Helmer | F04D 19/04 415/120 |

FOREIGN PATENT DOCUMENTS

| | | |
|---|---|---|
| CN | 102265037 A | 11/2011 |
| WO | WO2010074965 | 7/2010 |
| WO | 2011092674 A1 | 8/2011 |

OTHER PUBLICATIONS

Chinese Office action dated Mar. 2, 2017 from related Chinese Application No. 201310717450.8.

* cited by examiner

*Primary Examiner* — Woody Lee, Jr.

(57) ABSTRACT

A spiral pumping stage includes both centripetal and centrifugal pumping channels, so that the gas is pumped from the periphery to the center of the pumping stage throughout a first group of pumping channels and it is pumped from the center to the periphery of the pumping stage throughout a second group of pumping channels. Thanks to this inventive arrangement, both the gas coming from a previous pumping stage or a main pump inlet arranged upstream the pumping stage according to the invention and the gas coming from the additional side inlet can be effectively pumped by the pumping stage according to the invention.

20 Claims, 8 Drawing Sheets

SPIRAL PUMPING STAGE AND VACUUM PUMP INCORPORATING SUCH PUMPING STAGE

CROSS-REFERENCE TO RELATED APPLICATIONS

The present application claims priority under 35 U.S.C. §119(e) from European Application No. 13152233.6 filed on Jan. 22, 2013 naming Enrico Emelli, et al. as inventors. The entire disclosure of European Patent Application No. 13152233.6 is specifically incorporated herein by reference.

BACKGROUND

Molecular drag pumping stages produce pumping action by momentum transfer from a fast-moving surface (moving at a speed comparable to the thermal speed of the molecules) directly to gas molecules. Generally, these pumping stages comprise a rotor and a stator cooperating with each other and defining one or more pumping channels therebetween. Collisions of gas molecules in each pumping channel with the rotor rotating at a very high speed cause gas in the channel to be pumped from the inlet to the outlet of the channel itself.

The international patent application WO 2010/074965 in the name of the same Applicant of the present application discloses a molecular drag pumping stage comprising spiral pumping channels. In general, such a pumping stage comprises a stator ring having one or more spiral channels at least on a first face thereof and cooperating with the surface of a rotor disc rotating at high speed, the surface of the rotor disc being smooth and arranged opposite to the first face of the stator ring.

With reference to FIG. 1, if spiral channels are provided on both opposite faces of the stator ring, a first centripetal pumping stage 101 and a second centrifugal spiral pumping stage 102 connected in series can be obtained.

In detail a stator body 110 is provided on both surfaces 110*a*, 110*b* with spiral channels 112*a* and 112*b*, separated by corresponding spiral ribs 114*a* and 114*b*, respectively. A first rotor disc 116*a* having smooth surfaces is located opposite to a first surface 110*a* of the stator ring 110 and cooperates therewith for forming a first centripetal pumping stage 101 while a second rotor disc 116*b* having smooth surfaces is located opposite to a second surface 110*b* of the stator ring 110 and cooperates therewith for forming a second centrifugal pumping stage 102: the gas, coming from an inlet 118 placed at the outer periphery of the first pumping stage 101 flows through the first pumping stage in centripetal direction (arrow CP), passes through the passage 120 and then flows through the second pumping stage 102 in centrifugal direction (arrow CF), successively exiting through an outlet 122 placed at the outer periphery of the second pumping stage 102.

The pumping stages shown in FIG. 1 can be used in a vacuum pump in combination with other pumping stages of the same kind or of a different kind connected in series thereto, so that the gas flows through the pumping stages in centripetal and centrifugal direction alternately. Namely, the inlet 118 can put a previous centrifugal spiral pumping stage in communication with the first pumping stage 101 and the outlet 122 can put the second pumping stage 102 in communication with a successive centripetal spiral pumping stage.

Such pumping stages can also be used in combination with pumping stages of different kind, for instance they can be provided downstream a set of turbomolecular pumping stages in a turbomolecular pump.

A vacuum pump comprising a plurality of spiral pumping stages connected in series is shown in FIG. 2.

The vacuum pump 200 comprises a pump housing 202 in which a pump inlet 204 and a pump outlet 206 are defined and in which a plurality of spiral pumping stages are arranged between the pump inlet and the pump outlet.

To this aim, a plurality of stator rings 208, 210, 212 integral with the pump housing and provided with spiral channels 208*a*, 208*b*, 210*a*, 210*b*, 212*a*, 212*b* on both faces are arranged in the pump housing alternate with a plurality of rotor discs 214, 216, 218, 220 preferably having smooth surfaces and being mounted on a common shaft 222 that is centrally arranged in the pump housing and driven in rotation at high speed.

Thus, a plurality of alternate centripetal and centrifugal spiral pumping stages connected in series are obtained, and gas coming from the pump inlet 204 is pumped therethrough, as shown by the arrows F in solid line.

The vacuum pump 200 shown in FIG. 2 farther comprises a side inlet or additional inlet 224 provided at the side surface of the pump housing 202, between the pump inlet 204 and the pump outlet 206, namely between the first stator ring 208 and the second stator ring 210.

Both the pumping stage defined by the bottom face of the first stator ring 208 and the pumping stage defined by the top face of the second stator ring 210 face the side inlet 224. However, it will be evident from the above disclosure that the pumping stage defined by the spiral channels 208*b* on the bottom face of the first stator ring 208 does not participate in pumping a gas coming from the side inlet 224, as the spiral channels 208*b* define a centrifugal pumping stage.

Therefore, only the pumping stage defined by the spiral channels 210*a* on the top face of the second stator ring 210, which is a centripetal pumping stage, participates in pumping such gas coming from the side inlet 224, as shown by the arrows F' in broken line.

More precisely, the gas coming from the side inlet 224 is not equally pumped by all the pumping channels 210*a* on the top face of the second stator ring 210, but mainly by the channels that are in flow communication with the additional inlet; in other words, assuming to longitudinally split each pumping stage in two halves H1, H2, the gas is pumped mainly by the channels that are in the half H1 comprising the additional inlet 224. Such situation is summarized in FIGS. 3*a*-3*d*, showing transverse cross-sectional views of the pump 200 at different, successive pumping stages.

Namely:

- FIG. 3*a* shows the centripetal pumping stage defined by the spiral channels 208*a* provided on the top face of the first stator ring 208 in cooperation with the first rotor disc 214; in this pumping stage only the gas coming from the pump inlet 204 is pumped (arrows F);
- FIG. 3*b* shows the centrifugal pumping stage defined by the spiral channels 208*b* provided on the bottom face of the first stator ring 208 in cooperation with the second rotor disc 216; in this pumping stage only the gas coming from the pump inlet 204 is pumped (arrows F);
- FIG. 3*c* shows the centripetal pumping stage defined by the spiral channels 210*a* provided on the top face of the second stator ring 210 in cooperation with the second rotor disc 216; in the channels of this pumping stage that are in communication with the additional inlet 224 both the gas coming from the pump inlet 204 (arrows F) and the gas coining from the side inlet 224 (arrows F') are pumped, while in the remaining channels mainly the gas coming from the pump inlet 204 is pumped (arrows F);

FIG. 3*d* shows the centrifugal pumping stage defined by the spiral channels 210*b* provided on the bottom face of the second stator ring 210 in cooperation with the third rotor disc 218; in this pumping stage both the gas coming from the pump inlet 204 (arrows F) and the gas coming from the side inlet 224 (arrows F") are pumped.

It is evident from the above that the spiral pumping stages according to prior art cannot provide for an optimized configuration in case of vacuum pumps having a side inlet.

More particularly, since the pumping speed that can be attained at this additional side inlet is given by the sum of the pumping speeds of each pumping channel through which the gas is pumped, the limited number of pumping channels participating in the pumping of gas coming from the side inlet strongly limits the attainable effective pumping speed.

This and other objects are achieved by a spiral pumping stage as claimed in the appended claims and by a vacuum pump incorporating such pumping stage.

SUMMARY

According to a representative embodiment, the spiral pumping stage comprises both centripetal and centrifugal pumping channels, so that the gas is pumped from the periphery to the center of the pumping stage throughout a first group of pumping channels of the pumping, stage and it is pumped from the center to the periphery of the pumping stage throughout a second group of pumping channels of the pumping stage.

The spiral pumping stage according to the invention is suitable for being arranged downstream a first centripetal pumping stage and upstream a second centripetal pumping stage and it is intended to be placed at a additional side inlet of the vacuum pump.

Therefore, in the pumping stage according to the invention the pumping channels that are in flow communication with the additional side inlet—i.e. the pumping channels on the same side as the additional inlet—are centripetal pumping channels, so that they are able to pump the gas coming from this additional inlet from the periphery toward the center of the pumping stage, while the pumping channels that are not in flow communication with the additional side inlet—i.e. the pumping channels on the opposite side with respect to the additional inlet—are centrifugal pumping channels, so that they can be connected in series with the pumping channels of the previous centripetal pumping stage and pump the gas coming from this previous pumping stage from the center toward the periphery of the pumping stage, and they can also pump the gas coming from the centripetal channels of the pumping stage itself.

BRIEF DESCRIPTION OF THE DRAWINGS

Further features and advantages of the invention will be evident from the detailed description of a preferred embodiment of the invention itself, given by way of non-limiting example with reference to the attached drawings, wherein.

DETAILED DESCRIPTION

The present teachings relate generally to a spiral pumping stage for a vacuum pump and to a vacuum pump incorporating such pumping stage. More particularly, the present invention relates to a spiral molecular drag pumping stage particularly suitable for being used at a side inlet of a vacuum pump and to a vacuum pump comprising a side inlet and incorporating such pumping stage.

The spiral pumping stage according to the invention comprises, in a per se known way, a stator ring having spiral channels on at least one face thereof and cooperating with the surface of a rotor disc rotating at high speed and arranged opposite to the face of the stator ring. The rotor disc preferably has a smooth surface cooperating with the spiral channel of the stator disc.

Figure 1:
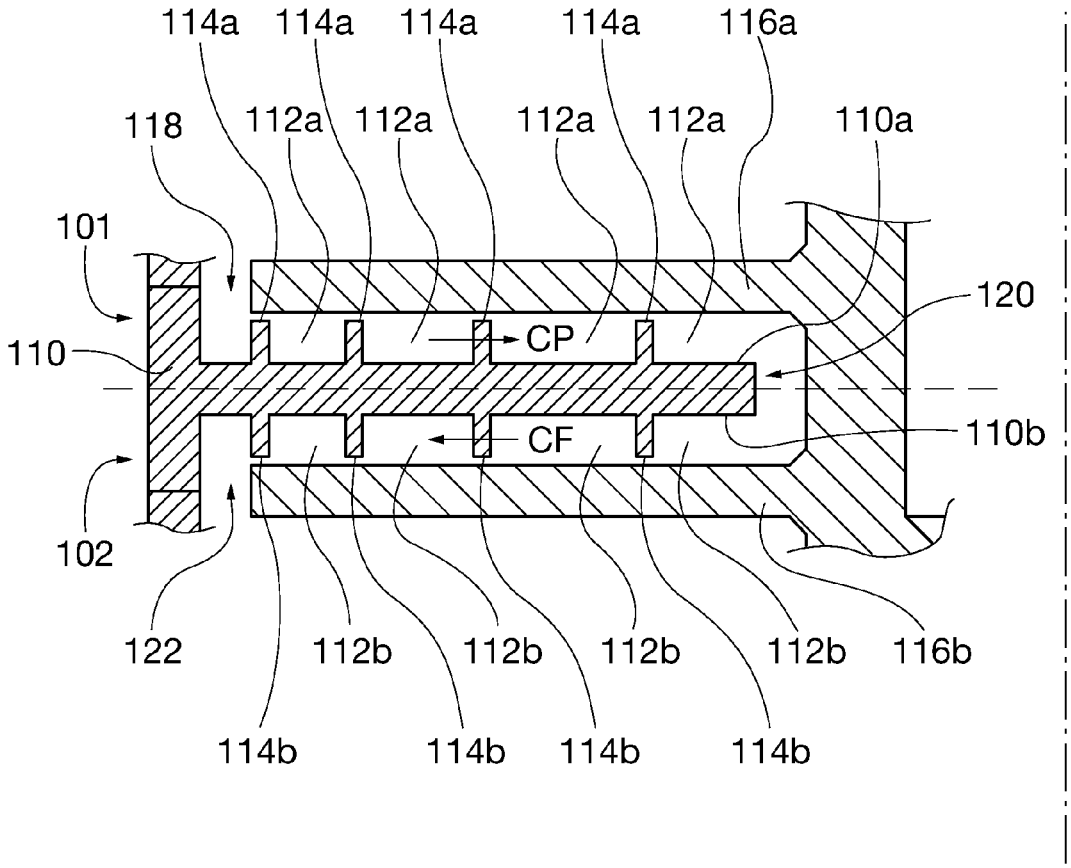
FIG. 1 is a longitudinal cross-sectional view of a pair of spiral pumping stages according to prior art.

More particularly, with reference to FIG. 1, the spiral pumping stage according to the invention comprises a stator ring 1 provided on its bottom face 1*a* with a plurality of spiral pumping channels, the bottom face 1*a* of the stator ring being intended to cooperate with the smooth face of a rotating rotor disc (not shown) so as to define a spiral pumping stage.

The pumping stage according to the invention is intended to be arranged downstream a previous centripetal pumping stage, such as a spiral pumping stage, or a main pump inlet and upstream a successive centripetal pumping stage, such a spiral pumping stage, or a pump outlet.

Accordingly, such pumping stage is provided with a first inlet or main inlet 3 at the inner perimeter of the stator ring 1 for putting the pumping stage according to the invention in communication with the previous centripetal pumping stage or with the main pump inlet, and with an outlet 5 at the outer perimeter of the stator ring 1 for putting the pumping stage according to the invention in communication with the successive centripetal pumping stage or with the pump outlet.

According to the invention, the pumping stage fu comprises an additional side inlet 7 at the outer side wall of the stator ring 1.

This additional side inlet is intended to be arranged at least partially, and preferably totally, overlapping a side additional pump inlet.

In order to be able to pump both the gas coming from the main inlet 3 and the gas coming from the additional side inlet 7, the stator ring 1 is divided into two circular sectors S1, S2, a first circular sector S1 extending on both sides of the additional side inlet 7 and a second circular sector S2 extending on the remaining portion of the stator ring 1.

Figure 4:
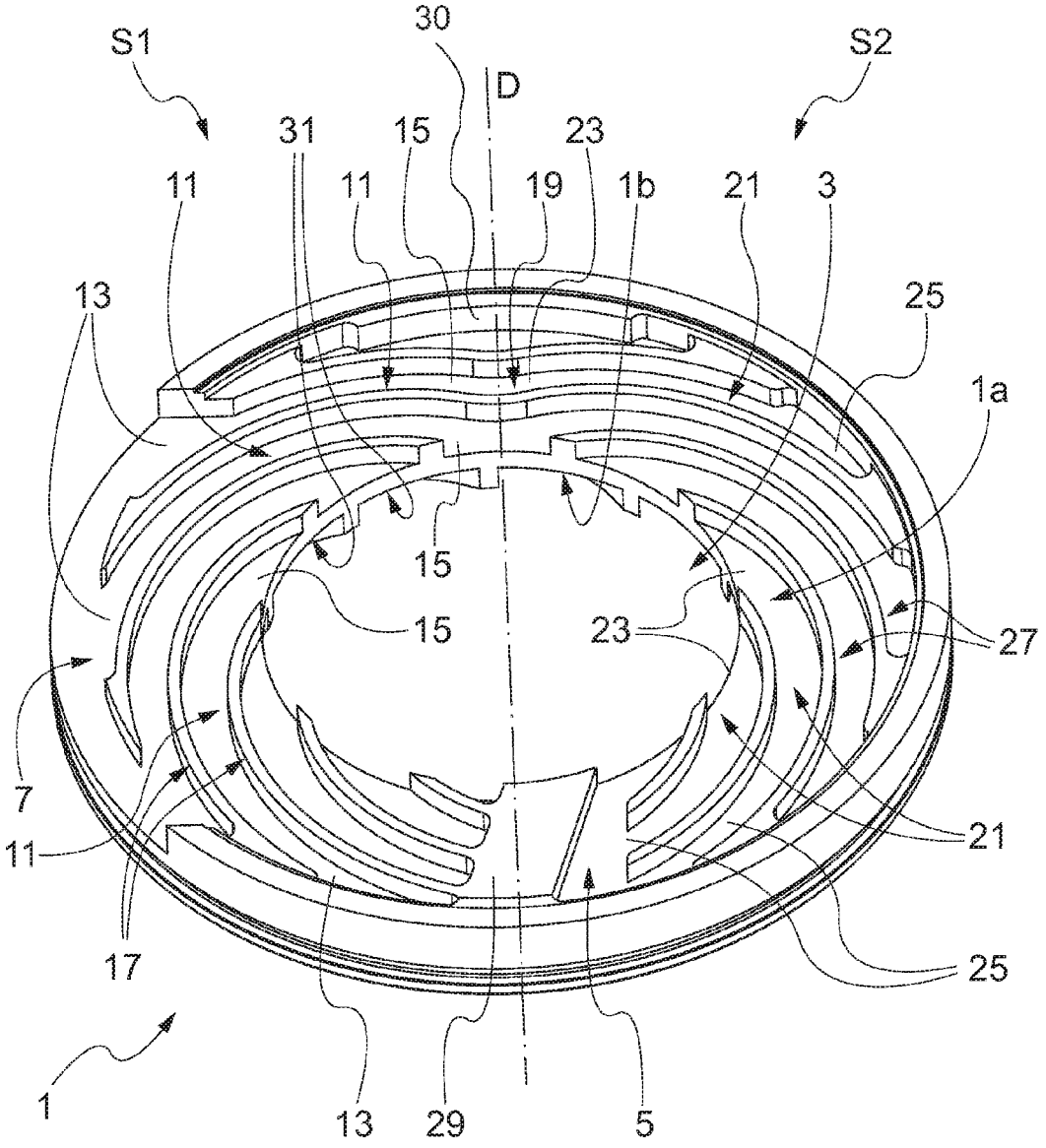
FIG. 4 is a perspective view of the bottom face of the stator ring of a spiral pumping stage according to the invention.

Although circular sectors of different amplitude can be provided, according to the preferred embodiment shown in FIG. 4, the first and second circular sectors S1, S2 have the same amplitude and the first circular sector S1 symmetrically extends on both sides of the additional side inlet, whereby the first circular sector S1 extends over an angle of 90° on both sides of the additional side inlet, i.e. over an overall angle of 180°, and the second circular sector S2 extends on the remaining portion of the stator ring 1, i.e. over an overall angle of 180° opposite to the additional side inlet 7.

In other words, according to the shown embodiment the stator ring 1 is subdivided into two equal circular sectors or halves along a diameter D.

According to the invention, the bottom face 1*a* of the stator ring 1 is provided with one or more centripetal pumping channels defined by corresponding spiral ribs 17 and extending in the first circular sector S1 of the stator ring, from respective channel inlets 13 at the outer perimeter of the stator ring 1 toward respective channel outlets 15 at the inner perimeter of the stator ring.

Always according to the invention, the bottom face 1*a* of the stator ring 1 is provided with one or more centrifugal pumping channels 21, defined by corresponding spiral ribs 27 and extending in the second circular sector S2 of the stator ring, from respective channel inlets 23 at the inner perimeter of the stator ring 1 toward respective channel outlets 25 at the outer perimeter of the stator ring.

In detail, the channel inlets 13 of the centripetal pumping channels 11 are in flow communication with the additional side inlet 7, while the channel outlets 15 of the centripetal pumping channels 11 are in flow communication either with the main inlet 3 located at the inner perimeter of the stator ring 1 or with the channel inlets 23 of corresponding centrifugal pumping channels 21, as explained in detail below.

On the other hand, the channel inlets 23 of the centrifugal pumping channels 21 are in flow communication either with the main inlet 3 or with the channel outlets 15 of corresponding centripetal pumping channels 11, while the channel outlets 25 of the centrifugal pumping channels 21 are in flow communication with the outlet 5.

Therefore, the operation of the pumping stage according to the invention will be evident to the person skilled in the art: the gas coming from a previous pumping stage or from the main pump inlet through the main inlet 3 located at the inner perimeter of the stator ring 1 is pumped by the centrifugal pumping channels 21 of the pumping stage according to the invention toward the outlet 5 and the successive pumping stage or the pump outlet; the gas coming from the additional side inlet 7 is pumped by the centripetal pumping channels 11 of the pumping stage according to the invention toward the inner perimeter of the stator ring 1 and it is successively pumped by the centrifugal pumping channels 21 of the pumping stage according to the invention toward the successive pumping stage or the pump outlet through the outlet 5.

In this way, the pumping stage according to the invention is advantageously capable of pumping both the gas coming from the main inlet 3 and the gas coming from the additional side inlet 7 toward the outlet 5.

Always with reference to FIG. 4, it is evident that the region at the line dividing the first and second circular sectors S1, S2, i.e. the region along the diameter D in the shown embodiment, represents a transition region between a region of centripetal pumping flow and a region of centrifugal pumping flow.

In case one or more centripetal pumping channels 11 arrive at this transition region before having reached the inner perimeter of the stator ring 1, the channel outlets 15 of these centripetal channels are joined to the channel inlets 23 of corresponding centrifugal pumping channels 21 through respective joining portions 19.

On the other hand, in case one or more centrifugal pumping channels 21 arrive at this transition region before having reached the outer perimeter of the stator ring 1, the channel outlets 25 of these centrifugal channels have to be separated from the channel inlets 13 of the centripetal channels 11 on the other side of the transition region, and to this purpose a stripper 29 radially extending from the inner perimeter of the stator ring 1 to the outer perimeter thereof is provided between the channel outlets 25 of these centrifugal pumping channels 21 and the channel inlets 13 of these centripetal pumping channels 11, whereby the pumped gas is led from the channel outlets 25 of these centrifugal pumping channels 21 to the outlet 5.

As the stripper 29 radially extends from the outer perimeter of the stator ring 1 to the inner perimeter thereof, it acts both in the axial direction leading the pumped gas from the channel outlets 25 of the centrifugal pumping channels 21 to the outlet 5—and in the radial direction—avoiding the passage of gas along the outer perimeter of the stator ring. A second stripper 30 is provided on the other side of the stator ring 1, at the transition region dividing the first and second circular sectors S1, S2, the second stripper 30 acting in the radial direction and avoiding the backflow of gas along the outer perimeter of the stator ring.

Always from FIG. 4 it can be seen that, in a per se known way, a plurality of centripetal spiral channels 31 are provided, on the top face 1*b* of the stator ring 1 itself, these centripetal spiral channels 31 cooperating with the surface of a rotor disc (not shown) rotating at high speed, the surface of the rotor disc being smooth and arranged opposite to the top surface 1*b* of the stator ring 1. Thus, the top face 1*b* of the stator ring 1 and the cooperating rotor disc are suitable for pumping a gas from the outer perimeter of the stator ring 1 toward the inner perimeter of the stator ring, i.e. toward the main inlet 3 of the pumping stage according to the invention, whereby they form the centripetal pumping stage immediately upstream the pumping stage according to the invention.

Figure 5:
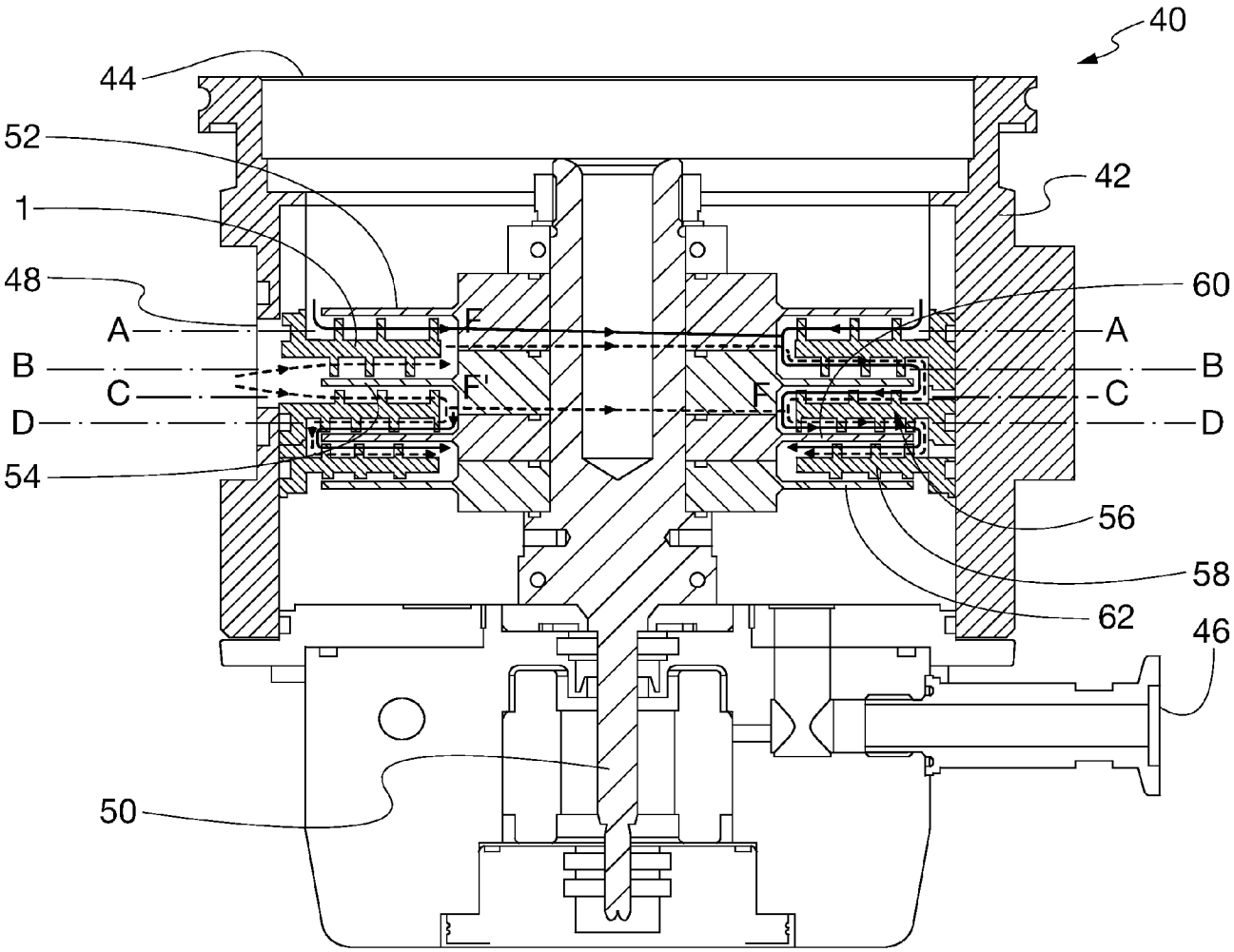
FIG. 5 is a longitudinal cross-sectional view of a molecular vacuum pump comprising a plurality of spiral pumping stages and further incorporating a spiral pumping stage according to the invention.

Turning now to FIG. 5, a vacuum pump 40 comprising a plurality of spiral pumping stages connected in series and including a spiral pumping stage according to the invention is shown.

The vacuum pump 40 comprises a pump housing 42 in which a main pump inlet 44 and a pump outlet 46 are defined and in which a plurality of spiral pumping stages formed by respective stator rings and corresponding cooperating rotor discs are arranged between the pump inlet and the pump outlet.

The vacuum pump 40 further comprises an additional side inlet 48 provided at the side surface of the pump housing 42, between the main pump inlet 44 and the pump outlet 46. In order to effectively pump both the gas coining from the main pump inlet 44 and the gas coming from the additional side inlet 48, a pumping stage according to the invention is provided in the vacuum pump 40 at the additional side inlet 48.

Therefore, the stator ring 1 as shown in FIG. 4 is arranged in the pump housing 42 alternate with corresponding rotor discs 52, 54 having smooth surfaces and mounted on a common shaft 50 that is centrally arranged in the pump housing and driven in rotation at high speed.

The pumping stage according to the invention is connected in series with a plurality of downstream arranged conventional spiral pumping stages formed by respective stator rings 56, 58, integral with the pump housing and provided with spiral channels on both faces, and cooperating rotor discs 60, 62.

Figure 2:
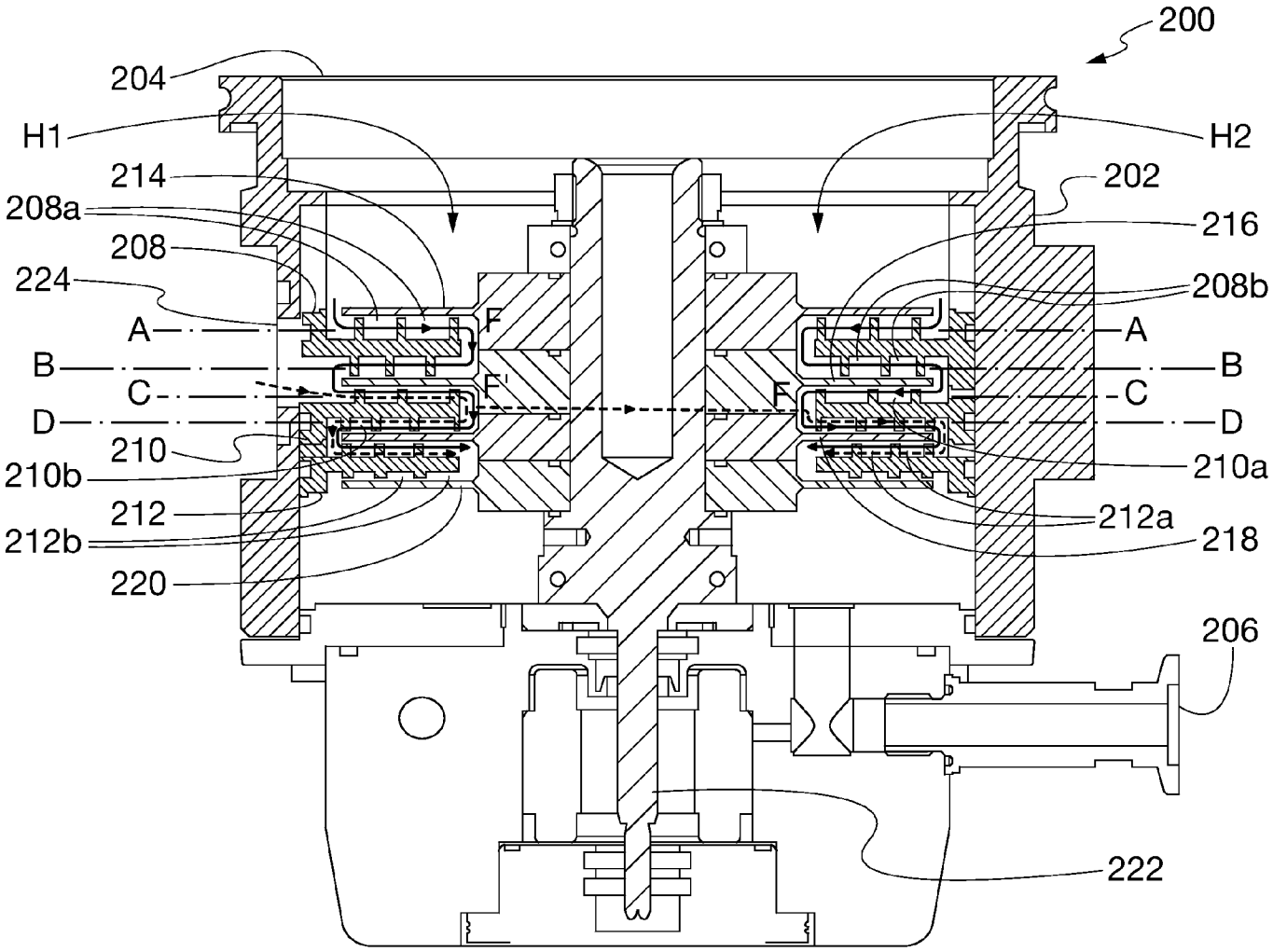
FIG. 2 is a longitudinal cross-sectional view of a molecular vacuum pump comprising a plurality of spiral pumping stages according to prior art.
Figure 3A:
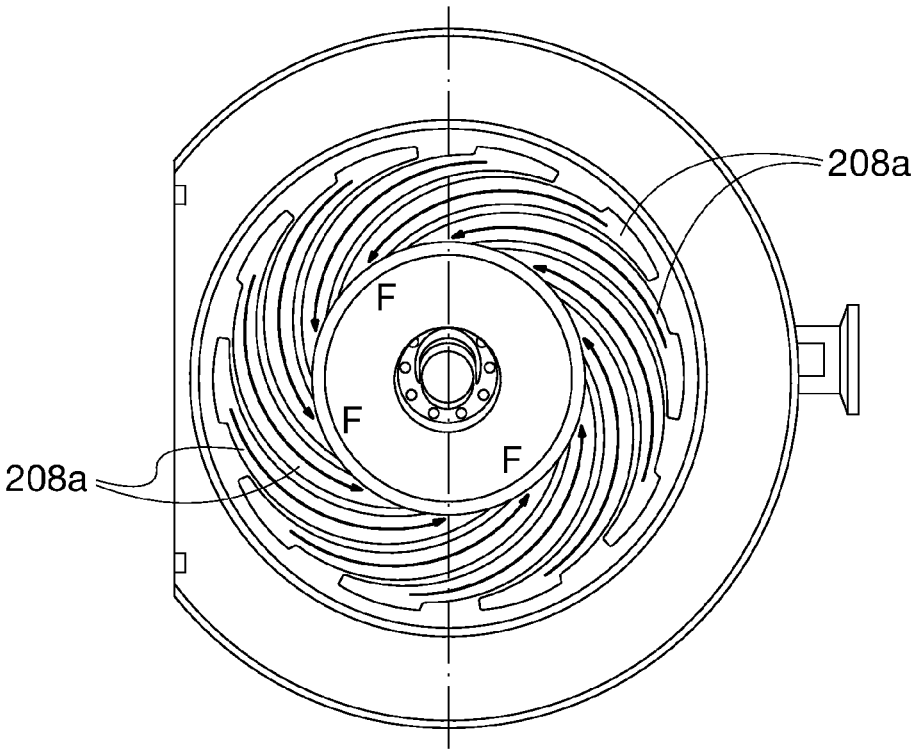
FIG. 3*a* is a transverse cross-sectional view according to line A-A of the molecular vacuum pump of FIG. 2.
Figure 3B:
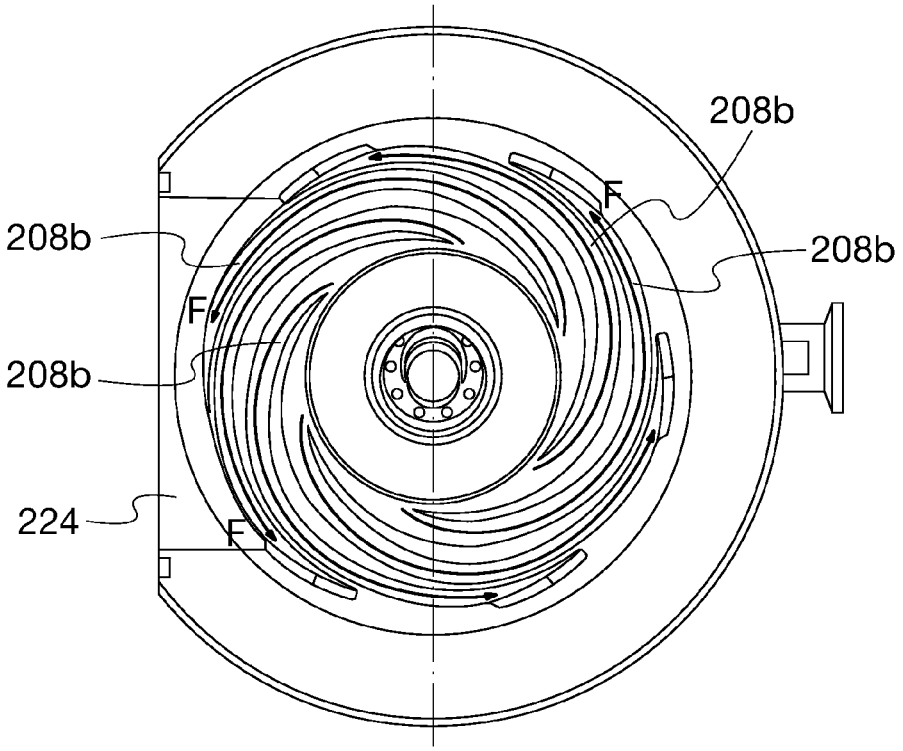
FIG. 3*b* is a transverse cross-sectional view according to line B-B of the molecular vacuum pump of FIG. 2.
Figure 3C:
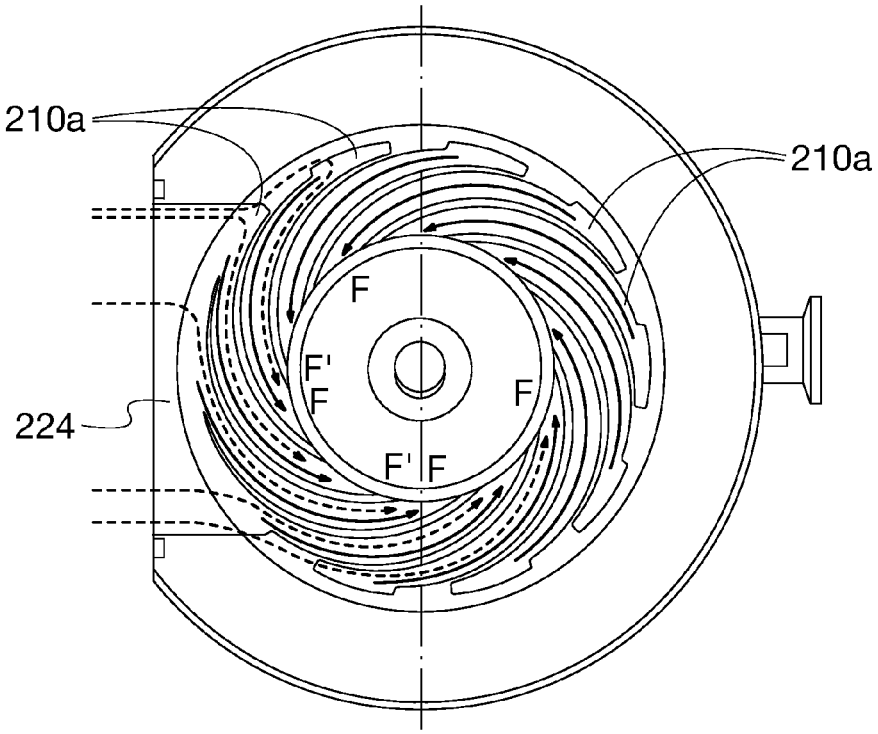
FIG. 3*c* is a transverse cross-sectional view according to line C-C of the molecular vacuum pump of FIG. 2.
Figure 3D:
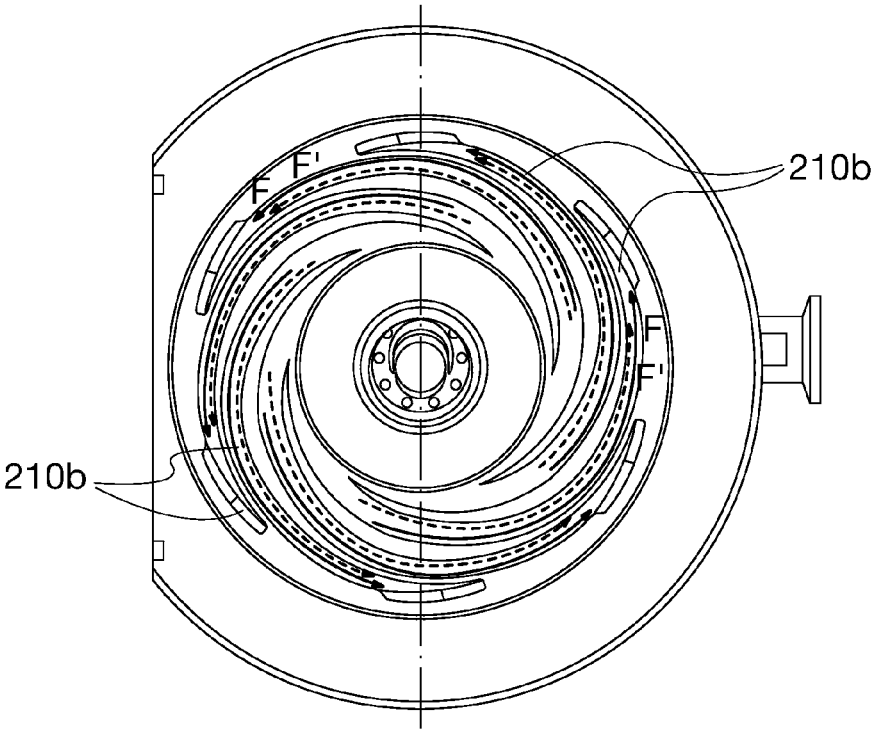
FIG. 3*d* is a transverse cross-sectional view according to line D-D of the molecular vacuum pump of FIG. 2.

It will be evident from the comparison between the vacuum pump 200 shown in FIG. 2 and the vacuum pump 40 shown in FIG. 5 that the provision of a spiral pumping stage according to the invention allows to improve the pumping efficiency of the vacuum pump 40, namely the pumping speed attainable at the additional side inlet 48.

Indeed, the spiral pumping stage according to the invention does participate in pumping the gas coming from the additional side inlet 48, thanks to the provision of centripetal pumping channels.

At the same time, the spiral pumping stage according to the invention also participates in pumping the gas coming from the main pump inlet 44, thanks to the provision of centrifugal pumping channels.

Figure 6A:
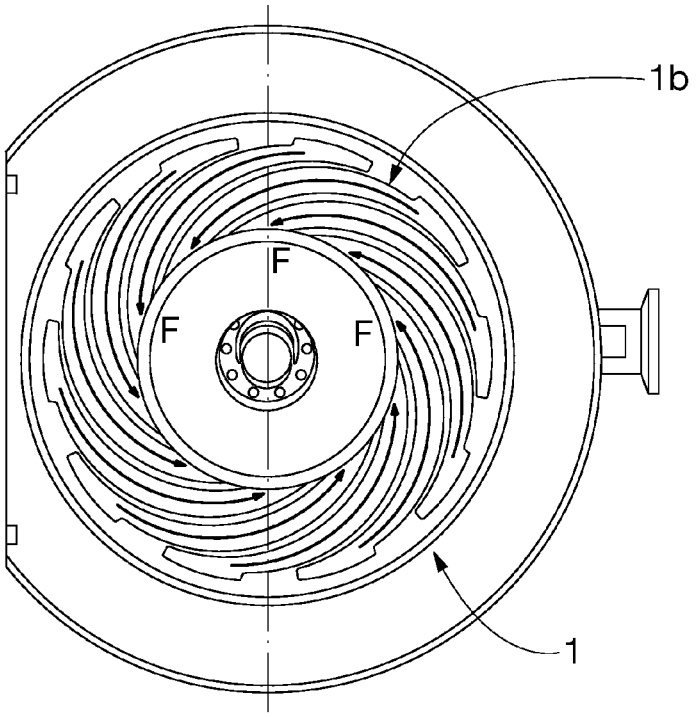
FIG. 6*a* is a transverse cross-sectional view according to line A-A of the molecular vacuum pump of FIG. 5.
Figure 6B:
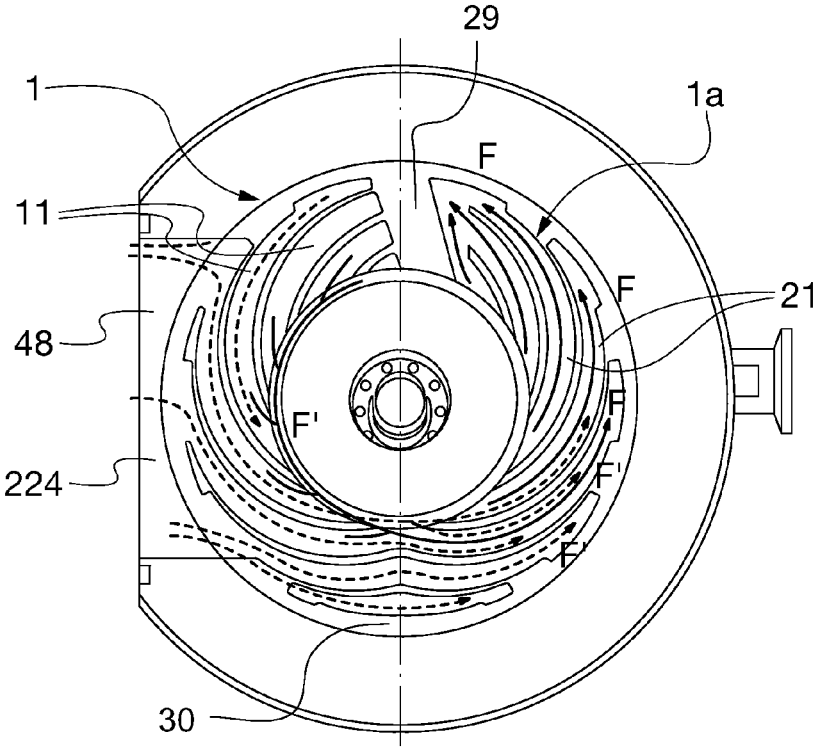
FIG. 6*b* is a transverse cross-sectional view according to line B-B of the molecular vacuum pump of FIG. 5.
Figure 6C:
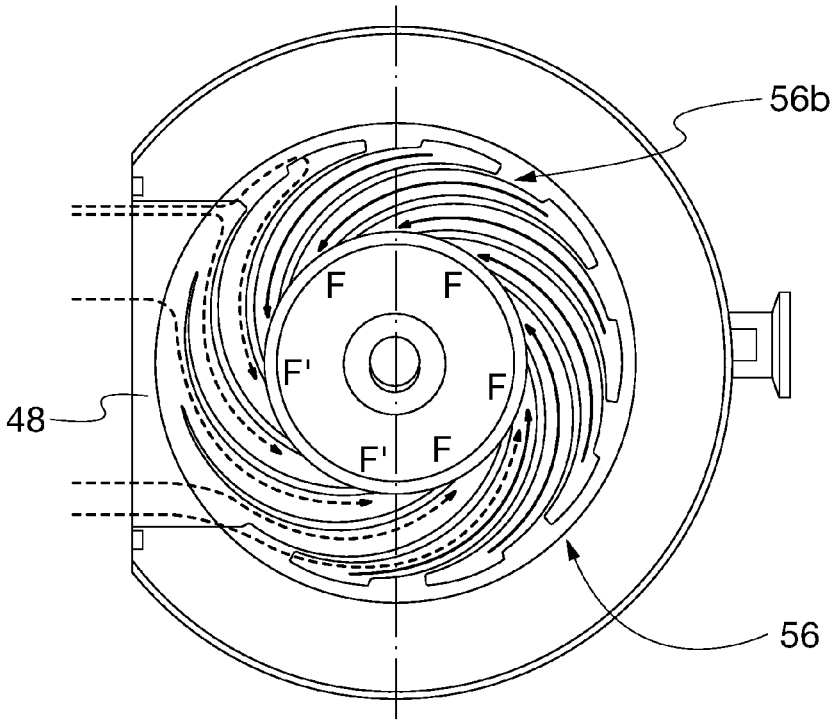
FIG. 6*c* is a transverse cross-sectional view according to line C-C of the molecular vacuum pump of FIG. 5.
Figure 6D:
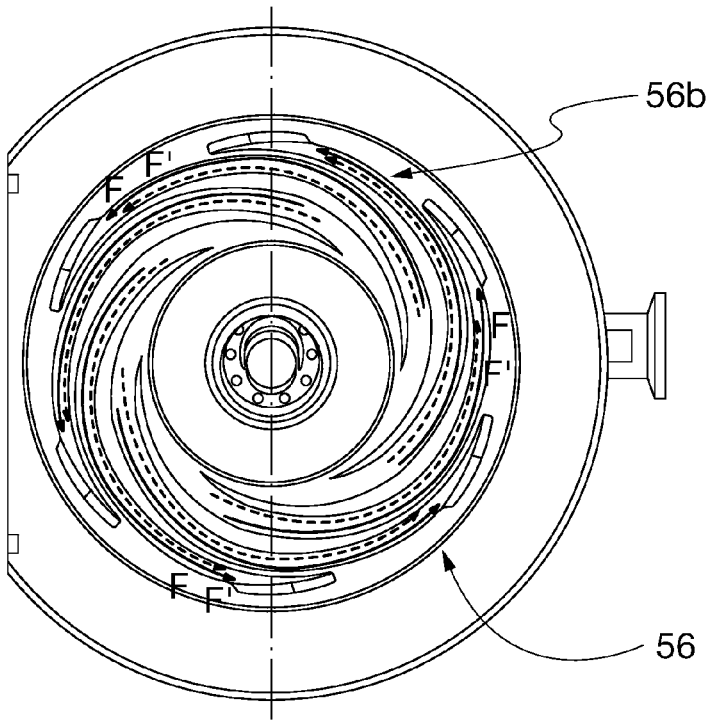
FIG. 6*d* is a transverse cross-sectional view according to line D-D of the molecular vacuum pump of FIG. 5.

In detail, and with reference to FIGS. 6*a*-6*d*, showing transverse cross-sectional views of the vacuum pump 40 at different, successive pumping stages:

FIG. 6*a* shows the centripetal pumping stage defined by the spiral channels provided on the top face 1*b* of the stator ring 1 of the pumping stage according to the invention in cooperation with the rotor disc 52; in this pumping stage only the gas coming from the main pump inlet 44 is pumped (arrows F);

FIG. 6*b* shows the pumping stage according to the invention and defined by the spiral channels provided on the bottom face 1*a* of the stator ring 1 in cooperation with the rotor disc 54; in this pumping stage the gas coming from the main pump inlet 44 is pumped through the centrifugal pumping channels 21 arranged in the second circular sector opposite to the additional side inlet 48 (arrows F) and the gas coining from the additional side inlet 48 is pumped both through the centripetal pumping channels 11 arranged in the first circular sector around the additional side inlet 48 and through the centrifugal pumping channels 21 arranged in the second circular sector opposite to the additional side inlet 48 (arrows F'); the stripper 29 prevents the gas from passing from the outlet of the centrifugal pumping channels 21 back in the centripetal pumping channels 11 and both the stripper 29 and the second stripper 30 prevents the gas from backflowing from centrifugal pumping channels towards centripetal pumping channels passing along the outer perimeter of the stator ring;

FIG. 6*c* shows the centripetal pumping stage defined by the spiral channels provided on the top face 56*b* of the stator ring 56 immediately below the pumping stage according to the invention in cooperation with the rotor disc 54; in the pumping channels of this pumping stage arranged in the first circular sector around the additional side inlet 48, which are in flow communication with the additional side inlet 48, the gas directly coming from the additional side inlet 48 is pumped (arrows F'), while the pumping channels of this pumping stage arranged in the second circular sector opposite to the additional side inlet 48 pump the gas coming from the main pump inlet 44 and the gas coming from the additional side inlet 48 and already pumped by the pumping channels provided on the bottom face 1*a* of the stator ring 1 of the pumping stage according to the invention (arrows F);

FIG. 6*d* shows the centrifugal pumping stage defined by the spiral channels provided on the bottom face 56*a* of the stator ring 56 immediately below the pumping stage according to the invention in cooperation with the rotor disc 60; in this pumping stage both the gas coming from the main pump inlet 44 (arrows F) and the gas coming from the additional side inlet 48 (arrows F') are pumped.

As mentioned above, the provision of the spiral pumping stage according to the invention allows to improve the pumping speed attainable at the additional side inlet of the vacuum pump.

In fact, in the vacuum pump 40 shown in FIG. 5 the effective pumping speed at the additional side inlet 48—$S_{48}$—is roughly given by the following formula.

$$S_{48} \cong M_1 \times S_2 + M_{56} \times s_{56}$$

wherein $s_1$ is the pumping speed of a single spiral channel provided on the bottom face of the stator ring of the pumping stage according to the invention, $M_1$ is the number of channels on the bottom face of the stator ring 1 facing the additional side inlet 48 and in flow communication therewith, $s_{56}$ is the pumping speed of a single spiral channel provided on the top face of the stator ring 56 immediately below the pumping stage according to the invention, and $M_{56}$ is the number of channels on the top face of the stator ring 56 facing the additional side inlet 48 and in flow communication therewith.

It is clear from the above description that the above formula would lack the first addendum in the case of a conventional vacuum pump such as the pump disclosed in FIG. 2, whereby the improvement in pumping speed due to the pumping stage according to the invention is evident.

It is also evident that the above description of a preferred embodiment of the invention has been given only by way of non-limiting example and that several modifications are possible without departing from the scope of the invention as defined by the appended claims.

More particularly, although the illustrated preferred embodiment refers to a molecular vacuum pump comprising a plurality of spiral pumping stages only, it is evident that the invention could be also implemented in a different kind of pump, such as a turbomolecular pump comprising a plurality of turbomolecular pumping stages arranged in series with a plurality of molecular drag pumping stages.

The invention claimed is:

1. A spiral pumping stage, comprising:

a stator ring comprising a plurality of spiral channels on at least one face thereof, an inner perimeter, an outer perimeter, and an outer side wall;

a rotor disc arranged opposite to the at least one face and configured for rotating at high speed;

a main inlet at the inner perimeter;

an outlet at the outer perimeter; and an additional side inlet at the outer side wall, wherein:

the stator ring is divided into a first circular sector extending to the additional side inlet and a second circular sector extending on a remaining portion of the stator ring; and the plurality of spiral channels on the at least one face comprises one or more centripetal pumping channels defined by corresponding spiral ribs and extending in the first circular sector from respective channel inlets of the one or more centripetal pumping channels at the outer perimeter toward respective channel outlets of the one or more centripetal pumping channels at the inner perimeter, and one or more centrifugal pumping channels defined by corresponding spiral ribs and extending in the second circular sector from respective channel inlets of the one or more centrifugal pumping channels at the inner perimeter toward respective channel outlets of the one or more centrifugal pumping channels at the outer perimeter.

2. The spiral pumping stage according to claim 1, wherein the channel inlets of the centripetal pumping channels are in flow communication with the additional side inlet and the channel outlets of the centripetal pumping channels are in flow communication either with the main inlet or with the channel inlets of corresponding centrifugal pumping channels.

3. The spiral pumping stage according to claim 2, wherein one or more of the channel outlets of the centripetal pumping channels arrive at a region along a line dividing the first circular sector from the second circular sector before having reached the inner perimeter, and are joined to the channel inlets of corresponding centrifugal pumping channels through respective joining portions.

4. The spiral pumping stage according to claim 2, wherein the channel inlets of the centrifugal pumping channels are in flow communication either with the main inlet or with the channel outlets of corresponding centripetal pumping channels and the channel outlets of the centrifugal pumping channels are in flow communication with the outlet.

5. The spiral pumping stage according to claim 4, comprising a stripper radially extending from the inner perimeter to the outer perimeter, wherein one or more of the channel outlets of the centrifugal pumping channels arrive at a region along a line dividing the second circular sector from the first circular sector before having reached the outer perimeter, and are joined to the outlet through the stripper.

6. The spiral pumping stage according to claim 5, wherein the stripper is a first stripper, and further comprising a second stripper positioned at a region dividing a first circular sector from the second circular sector and at a distance from the first stripper.

7. The spiral pumping stage according to claim 1, wherein the first circular sector symmetrically extends on both sides of the additional side inlet.

8. The spiral pumping stage according to claim 7, wherein the first circular sector extends over an angle of 90° on both sides of the additional side inlet.

9. The spiral pumping stage according to claim 1, wherein the main inlet is configured for flow communication with a centripetal pumping stage arranged upstream the spiral pumping stage.

10. The spiral pumping stage according to claim 1, wherein:

the at least one face is a bottom face;

the rotor disc opposite to the at least one face is a first rotor disc;

the stator ring comprises a top face, the top face comprising one or more centripetal pumping channels; and the top face is configured to cooperate with a second rotor disc arranged opposite to the top face to form the centripetal pumping stage arranged upstream the spiral pumping stage.

11. The spiral pumping stage according to claim 1, wherein the outlet is configured for flow communication with a centripetal pumping stage arranged downstream the spiral pumping stage.

12. A vacuum pump, comprising:

a pump housing comprising a main pump inlet, a pump outlet, and a side surface;

a plurality of spiral pumping stages formed by respective stator rings and corresponding cooperating rotor discs arranged between the main pump inlet and the pump outlet; and a side pump inlet provided at the side surface between the main pump inlet and the pump outlet, wherein the plurality of spiral pumping stages comprises a centripetal/centrifugal pumping stage, the centripetal/centrifugal pumping stage comprising:

a stator ring comprising a plurality of spiral channels on at least one face thereof, an inner perimeter, an outer perimeter, and an outer side wall;

a rotor disc arranged opposite to the at least one face at the side pump inlet, and configured for rotating at high speed;

a main inlet at the inner perimeter;

an outlet at the outer perimeter; and an additional side inlet at the outer side wall, wherein:

the stator ring is divided into a first circular sector extending to the additional side inlet and a second circular sector extending on a remaining portion of the stator ring; and the plurality of spiral channels on the at least one face comprises one or more centripetal pumping channels defined by corresponding spiral ribs and extending in the first circular sector from respective channel inlets of the one or more centripetal pumping channels at the outer perimeter toward respective channel outlets of the one or more centripetal pumping channels at the inner perimeter, and one or more centrifugal pumping channels defined by corresponding spiral ribs and extending in the second circular sector from respective channel inlets of the one or more centrifugal pumping channels at the inner perimeter toward respective channel outlets of the one or more centrifugal pumping channels at the outer perimeter, and wherein the centripetal/centrifugal pumping stage is arranged such that the additional side inlet at least partially overlaps with the side pump inlet.

13. The vacuum pump according to claim 12, wherein the centripetal/centrifugal pumping stage is arranged such that the additional side inlet completely overlaps with the side pump inlet.

14. The vacuum pump according to claim 12, wherein the centripetal/centrifugal pumping stage is arranged downstream the main pump inlet or downstream a centripetal pumping stage of the plurality of spiral pumping stages, and is arranged upstream a centripetal pumping stage of the plurality of spiral pumping stages or upstream the pump outlet.

15. The vacuum pump according to claim 12, further comprising a plurality of turbomolecular pumping stages arranged upstream the plurality of spiral pumping stages.

16. The vacuum pump according to claim 12, wherein, at the at least one face of the stator ring of the centripetal/centrifugal pumping stage, the channel inlets of the centripetal pumping channels are in flow communication with the additional side inlet and the channel outlets of the centripetal pumping channels are in flow communication either with the main inlet or with the channel inlets of corresponding centrifugal pumping channels.

17. The vacuum pump according to claim 12, wherein:

the at least one face is a bottom face of the stator ring of the centripetal/centrifugal pumping stage;

the rotor disc opposite to the at least one face is a first rotor disc;

the stator ring of the centripetal/centrifugal pumping stage comprises a top face, the top face comprising one or more centripetal pumping channels; and the top face is configured to cooperate with a second rotor disc of the plurality of spiral pumping stages, the second rotor disc arranged opposite to the top face, to form a centripetal pumping stage arranged upstream the centripetal/centrifugal pumping stage.

18. A spiral pumping stage, comprising:

a stator having one or more spiral channels on at least one face thereof, a rotor arranged opposite to the face of the stator and being configured for rotating at high speed, a first inlet, a side inlet, and an outlet, wherein:

the stator ring is divided into two circular sectors, with a first circular sector extending to the side inlet and a second circular sector extending on a remaining portion of the stator ring, the at least one face of the stator ring having spiral channels comprises one or more centripetal pumping channels, defined by corresponding spiral ribs and extending in the first circular sector of the stator ring, and the at least one face of the stator ring having spiral channels further comprises one or more centrifugal pumping channels, defined by corresponding spiral ribs and extending in the second circular sector of the stator ring.

19. The vacuum pump according to claim 16, wherein, at the at least one face of the stator ring of the centripetal/centrifugal pumping stage, the channel inlets of the centrifugal pumping channels are in flow communication either with the main inlet or with the channel outlets of corresponding centripetal pumping channels and the channel outlets of the centrifugal pumping channels are in flow communication with the outlet.

20. The vacuum pump according to claim 19, comprising a stripper radially extending from the inner perimeter to the outer perimeter, wherein one or more of the channel outlets of the centrifugal pumping channels arrive at a region along a line dividing the second circular sector from the first circular sector before having reached the outer perimeter, and are joined to the outlet through the stripper.

* * * * *